US005299483A

United States Patent [19]

Ber-Fong

[11] Patent Number: 5,299,483

[45] Date of Patent: Apr. 5, 1994

[54] CUTTING APPARATUS FOR FOAM SPONGES HAVING IRREGULAR CONTOURS

[75] Inventor: Huang Ber-Fong, Taipei, Taiwan

[73] Assignee: Sunkist Chemical Machinery Ltd., Taipei, Taiwan

[21] Appl. No.: 23,917

[22] Filed: Feb. 26, 1993

[51] Int. Cl.[5] ..... B26D 3/10

[52] U.S. Cl. ..... 83/870; 83/452; 83/565; 83/747; 83/758; 83/784

[58] Field of Search ..... 83/76.1, 76.6, 76.9, 83/171, 651.1, 565, 870, 874, 747, 758, 784, 452

[56] References Cited

U.S. PATENT DOCUMENTS

| | | | |
|---|---|---|---|
| 3,800,650 | 4/1974 | Schroder | 83/565 X |
| 4,077,301 | 3/1978 | Brahm | 83/171 X |
| 4,393,450 | 7/1983 | Jerard | 83/76.6 X |
| 4,608,893 | 9/1986 | Huhme | 83/171 |
| 4,754,678 | 7/1988 | Nichols et al. | 83/171 X |

*Primary Examiner*—Eugenia Jones
*Attorney, Agent, or Firm*—Bacon & Thomas

[57] ABSTRACT

A cutting apparatus for foam sponges with irregular contours comprises a foam sponge clamping mechanism, a cutter driving mechanism, a cutter rotating mechanism, a template, and a main frame. The main frame is equipped with a vertical frame on which are mounted a lead screw, a driving motor, and a clamping mechanism constituted of upper and lower clamping plates that are driven by the lead screw to secure foam sponges. The cutter driving mechanism and the cutter rotating mechanism are respectively installed on an U-shaped table located under the vertical frame; the driving mechanism making use of a motor mounted on the central rear of the table to drive a cutter rocking device through a combination of timing belts and rotary shafts so that the cutter can perform a reciprocating cutting operation, and the cutter rotating mechanism employing a duplicating needle attached to a hand wheel that is located on one side wall of a template insertion groove formed on one side of the table to dominate the rotation of the cutter through chains. Holding a foam sponge slab in the clamping mechanism and moving the duplicating needle of the hand wheel along the periphery of the pattern plate can cut the slab into foam sponges with an outline similar to that of the pattern plates.

1 Claim, 7 Drawing Sheets

CUTTING APPARATUS FOR FOAM SPONGES HAVING IRREGULAR CONTOURS

FIELD OF THE INVENTION

The invention relates to a foam sponge cutting apparatus, particularly to a foam sponge cutting apparatus that is designed to cut foam sponges with irregular outlines and can duplicate a variety of foam sponges as required according to a replaceable template having the same irregular curves as the outline of foam sponges to be cut.

BACKGROUND OF THE INVENTION

Manufacturers generally use foam slab machines to produce foam sponge slabs of great bulk and so these foam sponge slabs need to be cut by a cutting machine into required sizes and shapes in accordance with their individual applications.

As an example of inner lining foam sponges used for car seats, the outlines are either rectangular, square or slightly curved and so the cutting machines for them are also simple, only placing foam sponge slabs on a working table moving to and fro in conjunction with the cutting action of a saw blade and then a desired foam sponge product being made.

Naturally the cutting process for these foamed sponges with regular outlines is rather easy. But in some cases, the desired foam sponges should be of irregular outlines, for example, a streamlined outline with a lifting tail. The applications of those irregular foam sponges are increasingly popular, not to speak of the outlines full of variety being more attractive. And thus a conventional cutting machine for foam sponges with straight outlines is not suitable any longer.

SUMMARY OF THE INVENTION

It is therefore an object of the invention to provide a cutting apparatus for foam sponges with irregular curve profile that can produce foam sponges with various contours in a convenient way.

According to the invention, a cutting apparatus for foam sponges with irregular contours includes a base on which is installed a frame for mounting a clamping mechanism. The upper and lower clamping plate driving motors are seated on the base and respectively move the upper and lower clamping plates up and down through a combination of chains and a gear driven lead screw.

The two sides of the base are provided two round rod slide rails on which are equipped upstanding support columns. A U-shaped cutter table with its center of gravity being rotatably pivoted to the support columns is equipped with a cutter driving motor located on its central rear portion which motor drives a rocking mechanism via the arrangement of wheels, shafts, and timing belts, in turn, moves the two ends of a saw blade resulting in a sawing operation.

Further, on one side of the cutter table is formed a template insertion groove that has a hand wheel arranged on one of its side walls for driving the cutter and the template, which hand wheel has a duplicating needle attached thereto and protruding into the groove to deflect the movement of the rotary cutter support base situated on two ends of the saw blade.

When a template with an irregular pattern plate preset thereon is inserted into the groove, move the duplicating needle of the hand wheel along the periphery of the irregular pattern plate cooperated with turning the hand wheel. Accompanying with the swinging up and down of the cutter table about its support point and moving to and fro along the slide rails, the saw blade will cut the foam sponge slab held between the upper and lower clamping plates into foam sponges with a contour similar to the outline of the irregular pattern plate. And so the difficulty of cutting a foam sponge of irregular contours is overcome.

BRIEF DESCRIPTION OF THE DRAWINGS

The distinctive features and innovations of the invention will become apparent by reference to the following description taken in conjunction with the accompanying drawings in which.

DETAILED DESCRIPTION OF THE PREFERRED EMBODIMENT

Figure 1:
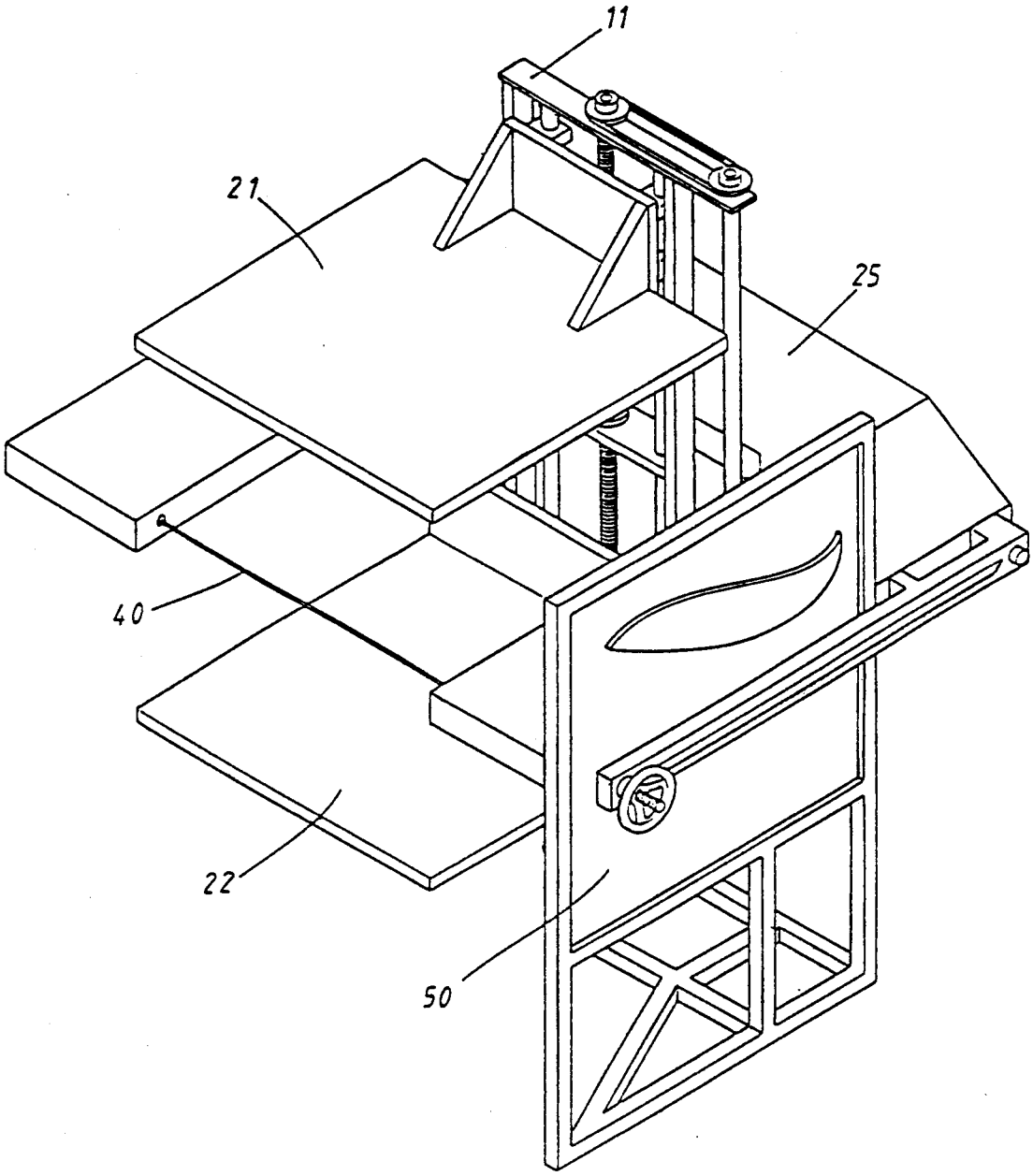
FIG. 1 is a perspective view of an embodiment according to the invention.
Figure 2:
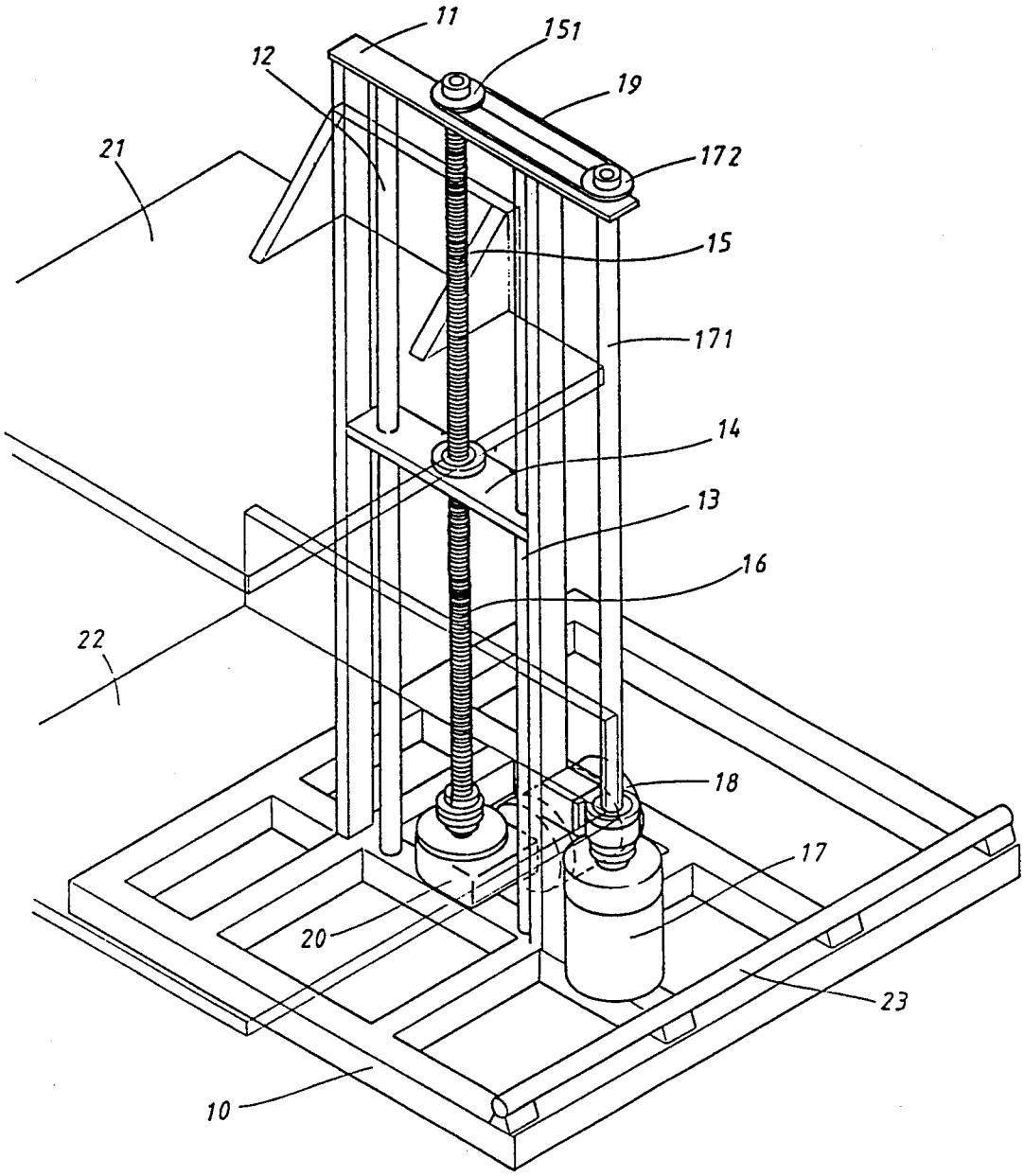
FIG. 2 is a perspective view of the main frame construction of the embodiment shown in FIG. 1.
Figure 3:
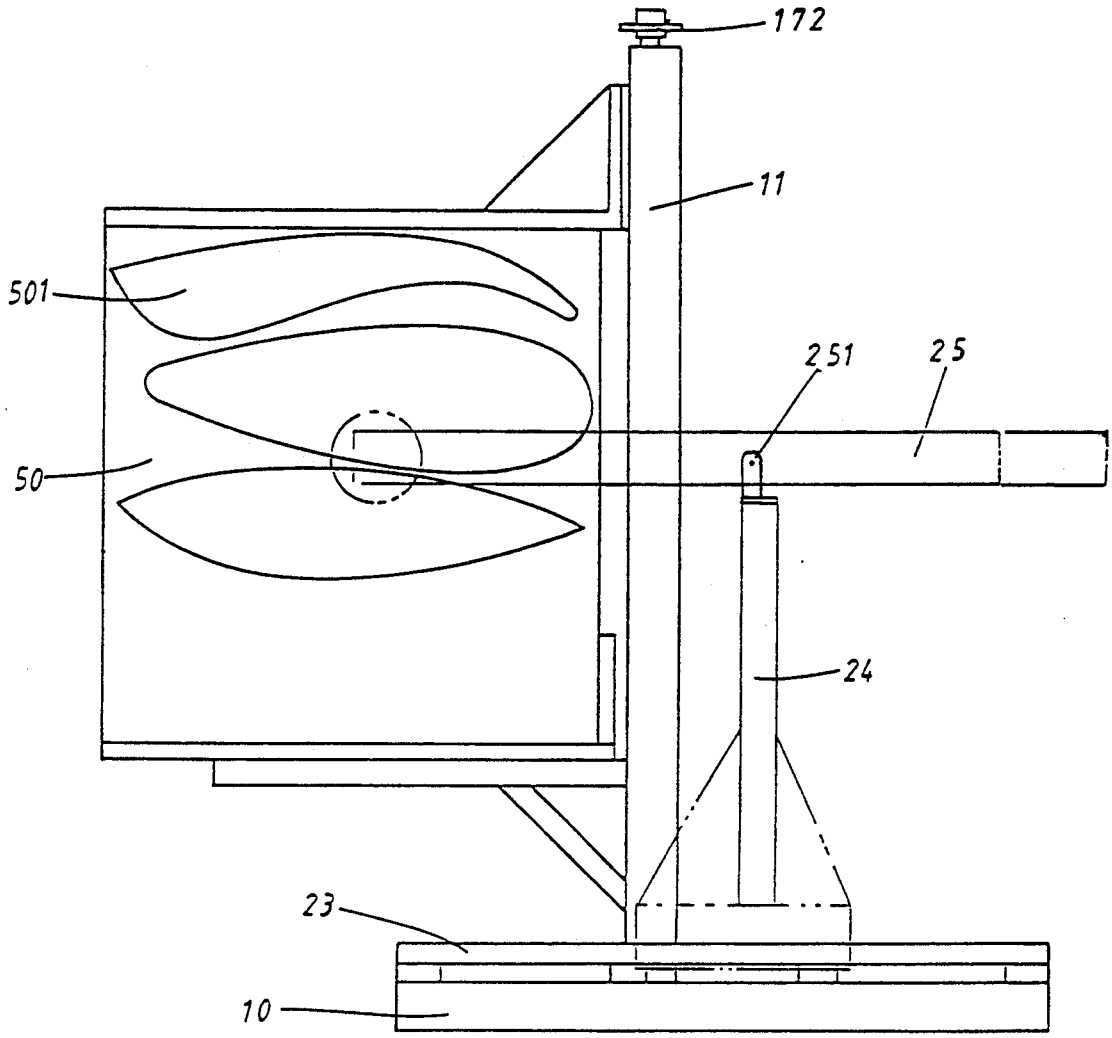
FIG. 3 is a side view of the embodiment shown in FIG. 1.

Referring to FIGS. 1–3, the embodiment of the invention generally includes a base 10 on the central portion of which is provided a vertical frame 11. Two locating posts 12 and 13 are vertically installed between the top plate of the vertical frame 11 and the base. A separator plate 14 is fixed to the frame 11 at approximately half height thereof. The upper and lower clamping plates 21, 22 are respectively situated between the top plate and the separator plate 14, and between the separator plate 14 and the base. Each is driven by driving motors 17, 18 located on the base 10. To the output shaft of the upper clamping plate driving motor 17 is coupled a long shaft 171 on the end of which is mounted a chain wheel 172. Between the chain wheel 172 and another chain wheel 151 mounted on one end of the lead screw 15 of the upper clamping plate is a chain 19 through which the upper clamping plate driving motor can rotate the lead screw 15. The lower clamping plate driving motor 18 governs the rotation of the lead screw 16 of the lower clamping plate via a reversing device 20 coupled to the output shaft of the driving motor. On the upper and the lower clamping plates 21, 22 are provided holes through which locating posts 12, 13 pass in the way that the rear edges of the clamping plates link with the lead screws 15, 16 and so the rotation of lead screws 15, 16 can drive the upper and the lower clamping plates 21, 22 to move to each other.

Figure 4:
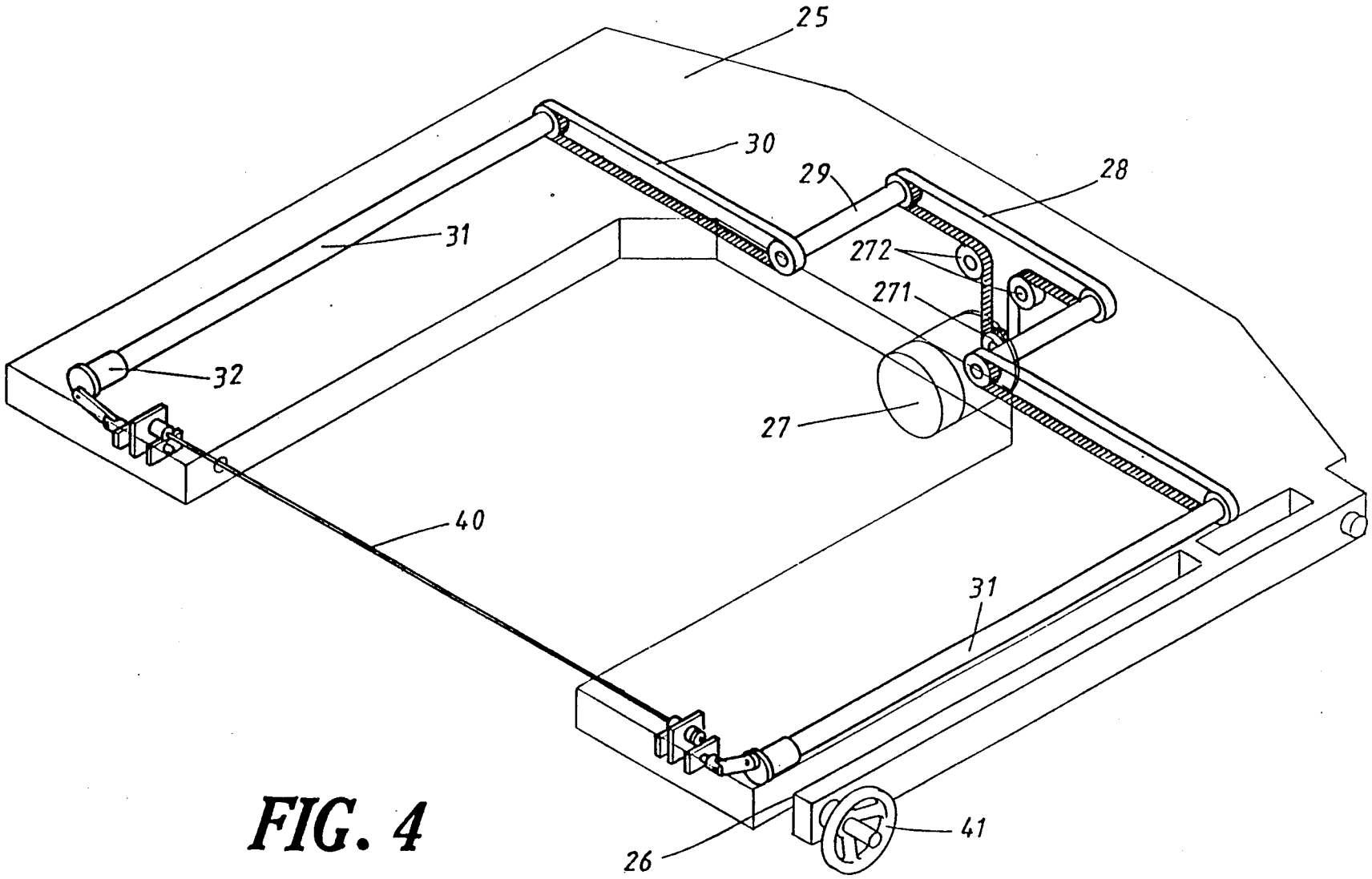
FIG. 4 is a perspective view illustrating the construction of the cutter driving mechanism of the embodiment shown in FIG. 1.
Figure 5:
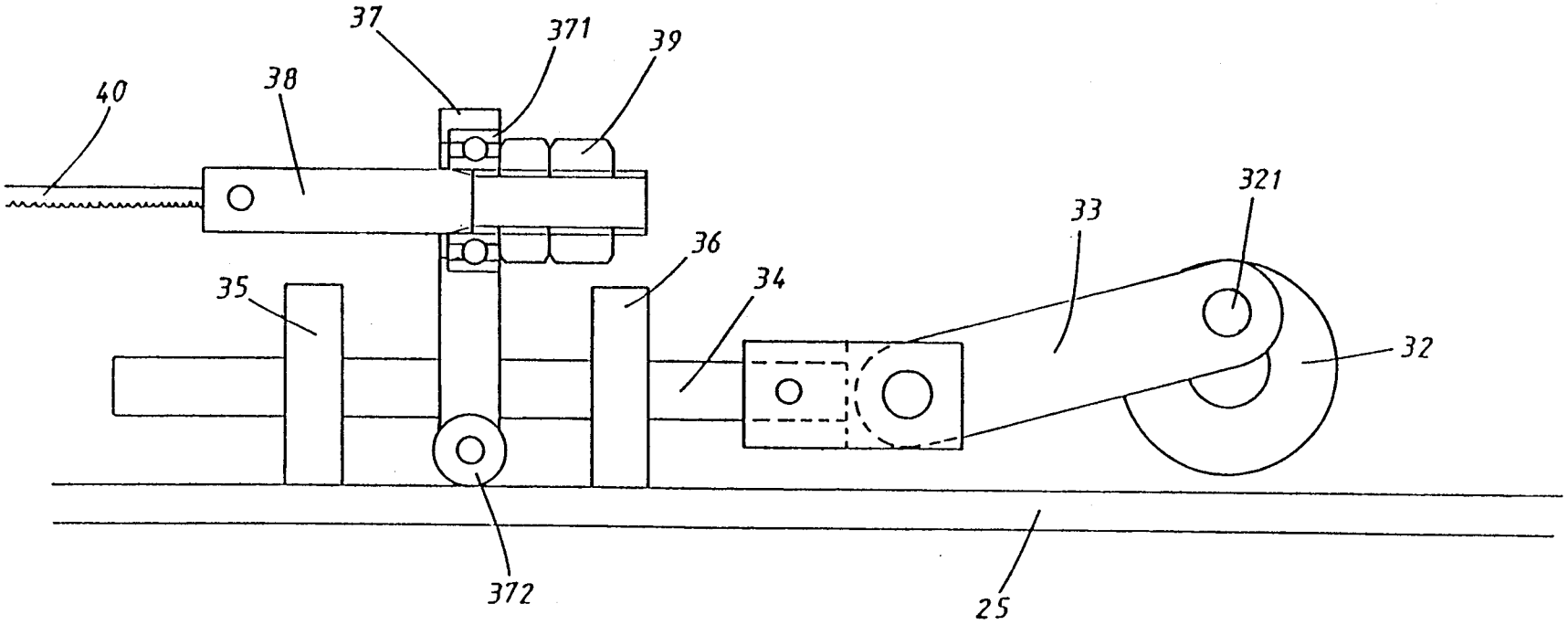
FIG. 5 a partial front view illustrating the construction of the cutter rocking mechanism of the embodiment.

As can be seen in FIGS. 1, 2, and 3 on two side edges of the base 10 are provided slide rails 23 (only one rail shown in the figures for representing). Two support columns 24 mount over the slide rails 23 and a cutter table 25 is pivotably supported at its own center of gravity by a stub 251 in a balanced state. The cutter table 25 has a U-shaped outline, referring to FIG. 4. A recessed groove 26 is formed on one side of the cutter table 25. A cutter driving motor 27 with a driving gear 271 mounted on its rotary shaft is set in the central rear portion of the cutter table. With the aids of two idle wheels 272, the timing belt 28 deflects and mounts on two shafts 29 so that the two shafts can simultaneously rotate in the same direction for the same angular displacement. The rotary force of the cutter driving motor 27 is transmitted by two timing belts 30 to two long shafts 31. Referring to FIG. 5, an axle housing 32 is secured to one end of the long shaft 31, on which housing is outfitted an eccentric shaft 321 to which is attached a rocker arm 33 linked with a push rod 34 of the cutter rocking mechanism. Two support plates 35, 36 are fixed on the cutter table 25 and a locating plate 37 seated between the two support plates is locked to the push rod 34. The locating plate 37 further contains a bearing 371 inserted thereon, and a pulley 372 provided on its end to maintain a smooth movement. A securing rod 38 for the saw blade 40 is mounted on the locating plate 37 through the bearing 371 and on its rear threaded end are provided two locknuts 39 to adjust the tension in the blade 40.

Figure 6:
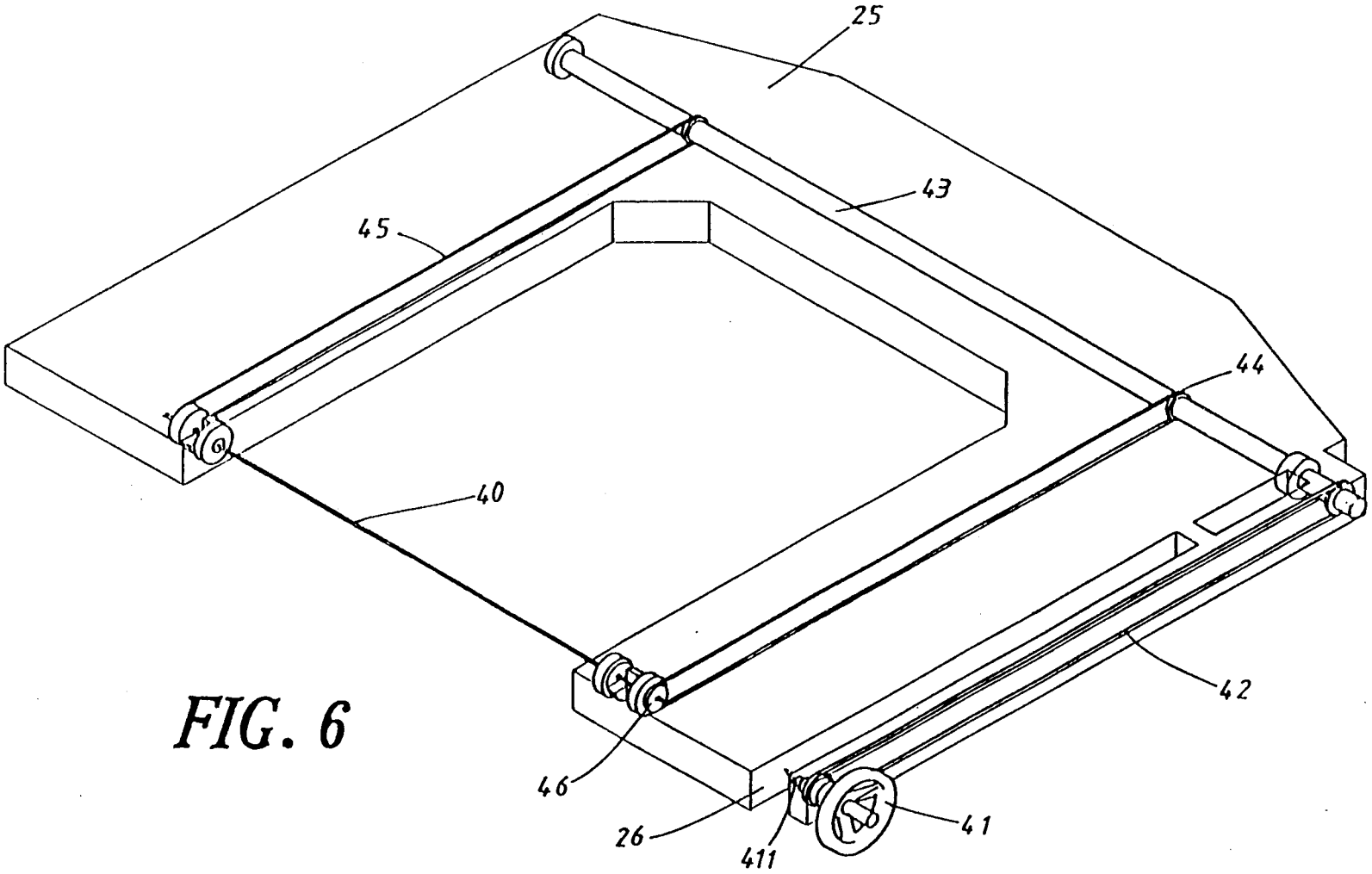
FIG. 6 is a partial perspective view illustrating the details of the cutter rotating mechanism of the embodiment.
Figure 7:
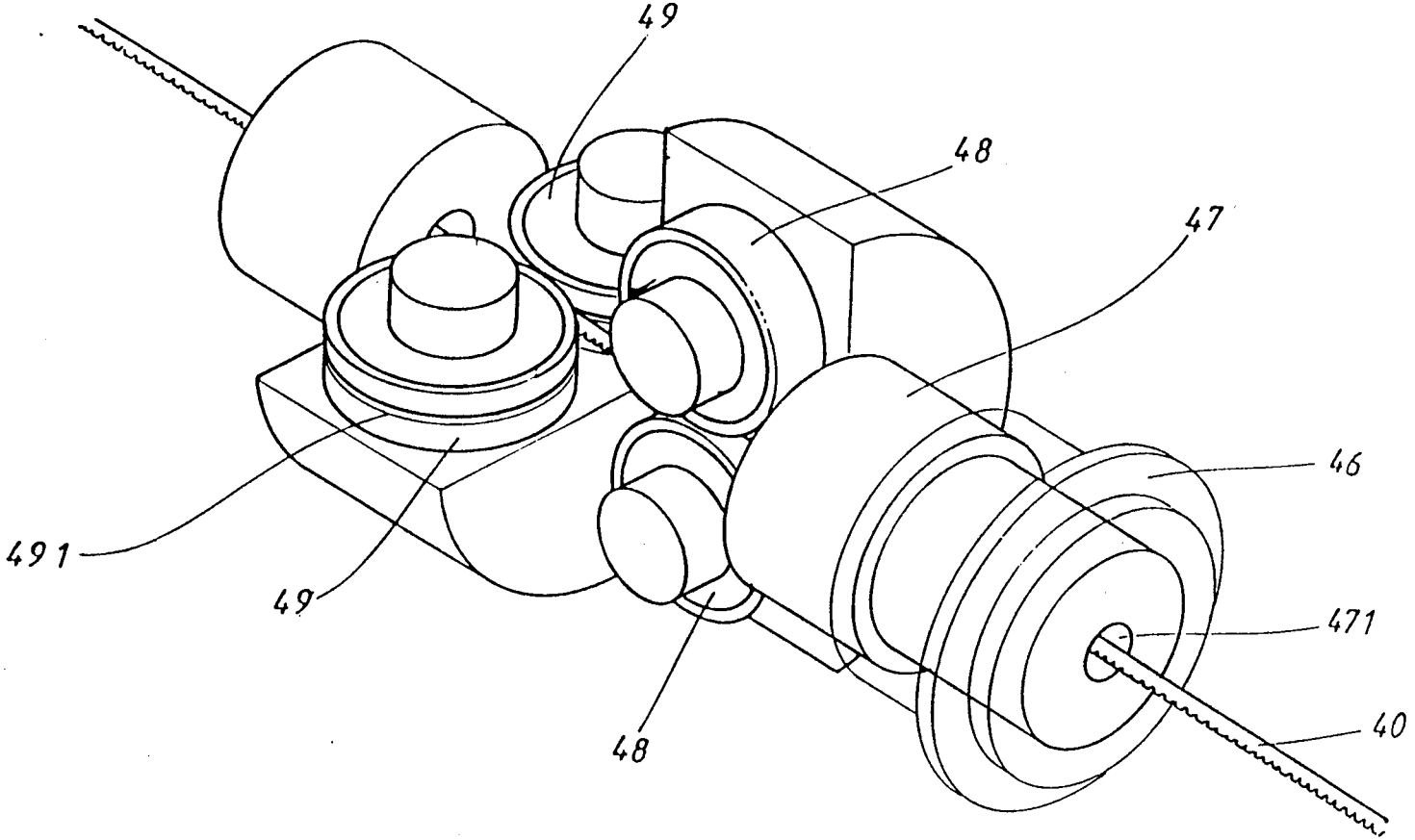
FIG. 7 is a partial perspective view of the rotary cutter support base of the embodiment.

Referring to FIGS. 6 and 7, the cutter rotating mechanism is also incorporated into the cutter table 25, in the construction of which a hand wheel 41 is provided on the side wall of the groove 26 and a chain 42 mounts over the hand wheel 41 and another shaft 43 that has chain wheels 44 mounted at two proper positions thereon and thus with the arrangement of the chains 45 the hand wheel 41 can control the rotation of the driving chain wheel 46. The driving wheel 46 is attached to a rotary cutter support base 47 having vertical and horizontal cutter holding units. A central hole 471 on the rotary cutter support base 47 allows the saw blade passing through. Two wheels 48 rotatably mount on the vertical holding unit to limit the saw blade 40; two more wheels 49 with grooves 491 formed thereon are pinned to the horizontal holding unit in the manner that the volume defined by grooves 491 permits saw blade 40 to pass. And so turning the hand wheel 41 can rotate the rotary cutter support base with the blade 40 together by means of the combination of chains and shafts.

Referring to FIGS. 1, 3, and 5, a template 50 with a preset pattern plate 501 thereon can be inserted into the groove 26. Moving along the periphery of the pattern plate 501 a duplicating needle 411 (shown in FIG. 6) of the hand wheel 41 protruding into the groove 26 and turning the wheel 41 to determine the cutting path of the blade 40 in cooperation with the swinging upward and downward of the cutter table 25 about the pivoting point and moving forward and backward of the support frame 24 along the rail 23 can obtain the desired irregular curve cutting.

The invention provides a new foam sponge cutting apparatus that makes use of the upper and lower clamping plates holding foam sponge slabs, a preset pattern plate, and various mechanisms to accomplish duplicating foam sponges having the same configuration as the irregular curve on the pattern plate. It is really a new and useful apparatus.

What is claimed is:

1. An apparatus for cutting foam sponges with irregular contours comprising:

a) a main frame with a base having slide rails formed on two sides, a vertical frame mounted on a central portion of the main frame, said vertical frame having a separator plate fixed thereto and two upright locating posts installed between a top of the vertical frame and the base;

b) a generally U-shaped cutter table defining a groove on one side thereof, said cutter table being pivotally supported generally at its center of gravity on pins on support columns slidably mounted on the slide rails;

c) a foam sponge clamping mechanism comprising: upper and lower clamping plates; upper and lower clamping plate driving motors fixed on the base; said upper clamping plate driving motor further having a first drive shaft attached to an output shaft thereof which extends to the top of the vertical frame; a chain wheel attached to the first drive shaft by which the output of the upper clamping plate motor is transmitted to a first lead screw operatively attached to the upper clamping plate via a chain; said lower clamping driving motor having a reversing device attached to an output shaft thereof and drivingly connected to a second lead screw operatively attached to the lower clamping plate and said upper and lower clamping plates being mounted on the two upright locating posts, wherein the first and second lead screws are respectively located over and under the separator plate;

d) a cutter driving mechanism comprising: a cutter driving motor mounted on a central rear portion of the cutter table having an output shaft equipped with a gear and a timing belt drivingly connected to two first cutter drive shafts to rotate the shafts simultaneously in the same direction, said two first cutter drive shafts having gears mounted thereon which are drivingly connected to two second cutter drive shafts located on opposite sides of the cutter table via two timing belts; and the two second cutter drive shafts each having a housing with an eccentric shaft attached thereto the eccentric shafts each attached to a respective rocker arm connected to a cutting blade for moving the blade to and fro;

e) a cutter rotating mechanism incorporated into said cutter table comprising: a hand wheel located on the side of the cutter table defining the groove, duplicating needle linked to the handwheel and extending into the groove; a chain drivingly connecting said hand wheel and a cutter rotating shaft, plurality of first chain wheels arranged on said cutter rotating shaft which are further connected via two chains to two second chain wheels each located on a respective rotary cutter support base on said cutter table, each of said rotary cutter support bases defining a central hole and having a vertical block and a horizontal block on which are respectively provided rotary wheels for holding the cutting blade; and f) a template on which is preset an irregular curve pattern plate inserted into said groove defined by the cutter table such that the pattern will contact the duplicating needle to form a cutting apparatus for foam sponges with irregular outlines.

* * * * *